United States Patent [19]

Rausing

[11] 4,367,842

[45] Jan. 11, 1983

[54] PACKING CONTAINER FOR PRESSURIZED CONTENTS

[75] Inventor: Hans Rausing, Lund, Sweden

[73] Assignee: Tetra Pak International AB, Sweden

[21] Appl. No.: 208,834

[22] Filed: Nov. 20, 1980

[30] Foreign Application Priority Data

Nov. 30, 1979 [SE] Sweden ..... 7909884

[51] Int. Cl.[3] ..... B65D 33/02

[52] U.S. Cl. ..... 229/55; 229/7 R; 426/110

[58] Field of Search ..... 229/54 R, 55, 17 R, 229/7 R; 426/106, 110

[56] References Cited

U.S. PATENT DOCUMENTS

| | | | |
|---|---|---|---|
| 3,154,238 | 10/1964 | Barnhill | 229/55 |
| 3,279,678 | 10/1966 | Lindh | 229/17 R |
| 3,462,070 | 8/1969 | Corella | 229/62 |
| 3,552,631 | 1/1971 | Fuchs | 229/7 R |
| 3,924,008 | 12/1975 | Ford et al. | 229/7 R |
| 4,172,152 | 10/1979 | Carlisle | 229/55 |
| 4,232,048 | 11/1980 | Palm et al. | 229/55 |

*Primary Examiner*—Stephen P. Garbe
*Attorney, Agent, or Firm*—Burns, Doane, Swecker & Mathis

[57] ABSTRACT

Cushion-shaped packing containers made of a liquid-tight tube which is sealed together at both ends by transverse sealing fins, cannot be used for pressurized contents, because the flexible plastic material of which the containers are made cannot be joined with sufficient strength in the sealing fins.

A strengthening element for the packing containers, and in particular for their sealing fins, is disclosed. The sealing fins are strengthened by an external strengthening band which joins the sealing fins. At the same time the fins are held folded down against the outside of the container so that the internal pressure in the container no longer acts upon the material layers sealed together in the sealing fin in a direction away from each other, but is transmitted instead to the seal between the respective fin and the strengthening band which seal can readily be given the required strength.

The invention also relates to a method for the manufacture of the packing containers described.

14 Claims, 4 Drawing Figures

PACKING CONTAINER FOR PRESSURIZED CONTENTS

BACKGROUND AND SUMMARY OF THE PRESENT INVENTION

The present invention relates to a packing container for pressurized contents.

Packing containers of the non-returnable type for pressurized contents, e.g. beer or carbonated beverages, are considerably more complex and expensive than packing containers for non-pressurized contents, e.g. juice or milk. This is due not only to the different and higher demands that are made on the capacity of the packing containers for pressurized contents to withstand an internal pressure, but also to the demand for a very high gastightness made on the material of which the packing containers are made. Whereas packing containers for non-pressurized contents can be manufactured simply at the same time as they are filled and can be given a simple tetrahedral or cushion-like shape, pressurized packing containers, because of the difficulty of finding an acceptable material which fulfills both the demands of mechanical strength and of high gastightness. Containers for pressurized contents must be given a complicated shape and must be manufactured from several different materials, e.g. a plastic and aluminium laminate so as to obtain the desired gas tightness, and a fibrous material arranged on the outside in order to ensure the required mechanical strength.

A known package of this type thus consists of a liquid-and gastight container of plastic material, which is surrounded for the most part by a casing of laminated paper material. While the free end parts of the liquid-tight container, because of the high internal pressure, must be made of thick plastic material, the remaining part of the container, that is to say the part of the container which is surrounded by the laminated casing, may be made of thin plastics, since the casing takes up the pressure loads caused by the contents and relieves the container wall. This brings about a certain economy in material, but the packing container thus configured becomes relatively complicated in its design and manufacture.

It would be desirable therefore to have a packing container for pressurized contents which is as simple as possible in its shape, and which is uncomplicated and economical with regard to material in its design. These requirements are met to a high degree by a cushion-shaped packing container, but it has not been possible up to now to impart to such a packing container sufficient mechanical strength so as to withstand the possible internal pressure.

It is an object of the present invention to provide a packing container for pressurized contents which does not have the disadvantages of the previously known packing containers and which makes use in an optimum manner of the materials from which it is made.

It is a further object of the present invention to provide a packing container for pressurized contents which, in spite of fulfilling the demands made with regard to tightness and strength, is of a design which is economical in respect of materials and of cost.

These and other objects have been achieved in accordance with the invention in that a packing container for pressurized contents comprising a liquid-tight container with two sealing fins situated at a distance from each other, which are folded down against the outside of the container, are joined together by means of an external strengthening element.

Preferred embodiments of the packing container in accordance with the invention have been given the further characteristics described in detail below.

By shaping the liquid-tight container from a flexible tube which on both its ends is flattened and sealed together to form mutually parallel sealing fins, a container of uncomplicated cushion-form is obtained for which a minimum of material is consumed. The walls of the packing container, without any difficulty, tolerate high internal pressure loads, but the sealing fins formed at the ends of the cushion require some form a strengthening in order to permit an equally high internal pressure as the remaining parts of the container. This strengthening is achieved in accordance with the invention in that the sealing fins are folded down against the outside of the container and are mutually joined by means of an external strengthening element which is attached to the outside of each fin when it is in folded down position. The elongated strengthening element, which is in the shape of a band, thus serves to absorb tensile stress and extends along the whole of one side of the container. It may be said that the strengthening element primarily fulfils two functions, namely in the first place the holding down of the sealing fins of the container in contact against the outside of the seals, and secondly the taking up of a large part of the stresses which are caused by the internal pressure.

The present invention also relates to a method of manufacture of a packing container for pressurized contents. Earlier known packing containers for pressurized contents, as mentioned previously, were usually made of several parts, namely an inner container and an outer strengthening casing for the greater part surrounding the same. The manufacture of these packing containers must necessarily be complicated, since it has to be done in several steps with assembly between the steps. The finished packing container is filled subsequently in a separated working phase and capped.

It would be desirable to simplify this method of manufacture and to provide a packing container which can be manufactured while being filled at the same time, so that the majority of the working phases required previously become unnecessary.

It is an object of the present invention, therefore, to provide a method for the manufacture of a packing container for pressurized contents which does not have the disadvantages of previously known methods of manufacture.

It is a further object of the present invention to provide a method for the manufacture of a packing container for pressurized contents, which method is suitable for automatic manufacture.

These and other objects have been achieved in accordance with the invention in which a method for the manufacture of packing containers for pressurized contents includes sealing off a tube filled with contents in transverse zones so as to form cushion-shaped containers with sealing fins situated at a distance from each other. The sealing fins are folded down against the outside of the container and are then retained in this position by means of a strengthening element which is applied to the outside of the container.

Preferred embodiments of the method in accordance with the invention have been given further characteristics as described in detail below.

The method in accordance with the invention makes it possible to continuously manufacture cushion-shaped containers from a tube filled with contents. By making use of a multiparts strengthening element each of the sealing fins can be joined to the respective part of the strengthening element while the fin is still in its original position, disposed substantially axially with the packing container. This facilitates the sealing between the fin and the strengthening device and makes it possible moreover, prior to the ultimate connecting together of the two parts of the strengthening element, to adapt the length of the strengthening element accurately in such a manner that in its effective position it fits well against the outside of the container and takes up the stresses caused by the internal pressure.

The packing container in accordance with the invention and the method for the manufacture of the same will now be described in more detail with special reference to the enclosed drawing which schematically shows two embodiments of a packing container in accordance with the invention.

DETAILED DESCRIPTION OF THE PREFERRED EMBODIMENTS

Figure 1:
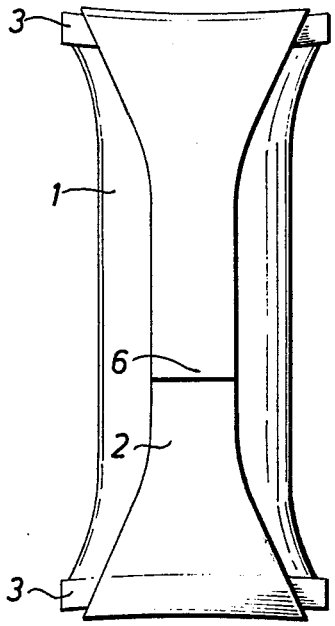
FIG. 1 is a back view of a preferred embodiment of a packing container in accordance with the invention.
Figure 2:
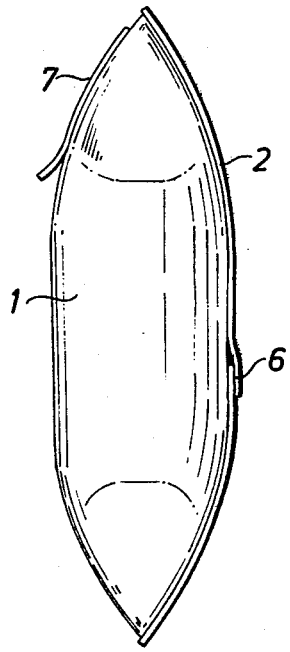
FIG. 2 is a side view of the packing container FIG. 1.

With reference to FIG. 1, the packing container in accordance with the invention comprises a liquid-tight container 1 and a strengthening element 2 extending over one side of the same. The liquid-tight container 1 is constituted of a flexible tube which on both ends is flattened and sealed together so as to form two sealing fins 3 situated at a distance from each other. The sealing fins, which thus extend over the upper and lower ends of the substantially cushion-shaped containers are mutually parallel and are folded down against the outside of the packing container. The sealing fins are retained in this folded-down position with the help of the strengthening element 2. More particularly, each of the two fins 3 is joined with its outside, when in folded down condition, to the respective end region of the strengthening element 2, which prevents the fins from rising to their original, "natural" condition axially in line with the container.

As is evident from the figures, the end regions of the strengthening element are joined to the sealing fins 3, and are folded down in the same direction, by means of overlap joints. The active part of the strengthening element 2 situated between the seals is of such a length that the strengthening element takes up the axial tensile stresses which are caused by the internal pressure in the container 1. This is achieved if the active length of the strengthening element 2 is equal to or less than the distance between the folded down sealing fins 3. For this purpose the distance is measured along the side of the filled container 1, that is to say the side along which the strengthening element runs. To assure the said strengthening function it is essential, moreover, for the strengthening element to be manufactured from a material or a material combination having a coefficient of linear expansion the same as or lower than that of the material from which the container 1 is manufactured.

The container 1, as well as the strengthening element 2, preferably comprise layers of oriented thermoplastic material, since such material has great strength in relation to its weight. The container 1 may be made, for example, of a biaxially oriented acrylonitrile material or any other oriented thermoplastic material. The container 1 may also be made of a laminated material which comprises different layers so as to ensure strength as well as gastightness. Such a conceivable material is a laminate comprising layers of polyester and aluminium foil or layers of polyethylene and aluminium foil. Further material combinations are of course also conceivable, but these will be well-known to those versed in the art and do not have to be described therefore in this connection.

In accordance with the preferred embodiment of the packing containers according to the invention the container 1 is manufactured from a weblike material which is converted to a tube of the desired diameter. In the course of this the tube is provided with a longitudinal joint (not shown in the figures), which for reasons of strength is in the form of an overlap joint of the desired width. Since the materials or material combinations from which the containers are manufactured all comprise a layer of thermoplastic material, the sealing of the longitudinal joint is performed by heat-sealing, that is to say the material is heated to such a temperature that the thermoplastic material included softens whereupon a pressing together of the two overlapping edge regions of the material web takes place, so that the material layers are welded together to a liquidtight seal.

A cushion-shaped container which has been manufactured from a material of a certain predetermined strength and which has been provided with a joint of a suitable width and strength can endure relatively large radial stresses without losing its tightness. However, the seals at the two ends of the cushion-shaped container are critical, since these cannot be given such a strength that they are capable of enduring the same internal pressure as the remaining parts of the container. The main reason for this is that in the conversion of the container from tubular shape to cushion shape the cushion ends are sealed inside to inside. That is to say the tube is flattened in a transverse zone and heat-sealed so that the sealing fins 3 mentioned earlier are formed. This type of seal, that is to say inside to inside, cannot be made as strong as an overlap seal, but is the only type of seal which is appropriate for use in sealing off of a tube to cushion-shaped containers. The difference in strength between a fin joint, that is to say a seal of the material inside to inside, and an overlap seal is primarily a consequence of the fact that the forces which endeavour to break the seal in the former case act perpendicularly to the sealed surfaces and in the latter case in the plane of the sealed surfaces. In the two sealing fins of the cushion-shaped containers the forces caused by the internal pressure will thus attack the sealing area along the edge turned towards the inside of the packing container, which makes the risk of separation (splitting) great, even under relatively moderate stresses.

Figure 3:
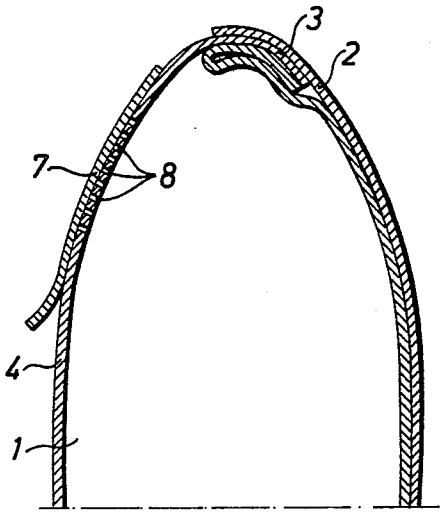
FIG. 3 is a expanded sectional view through the upper part of the packing container in accordance with FIG. 2.

In accordance with the invention the end parts of the cushion-shaped container and the packing container as a whole are formed in such a manner that the inner pressure in the packing container and the forces caused by the same are made use of instead for pressing together the material layers joined to one another in the sealing fins. This is achieved by the folding down of the sealing fins against the outside of the container and the mutual joining of the outer side of the sealing fins in folded down condition to the strengthening element 2. It is evident from FIG. 3, which shows a section through the upper part of a packing container in accordance with the invention, how the strengthening element 2 is joined by means of an overlap joint to the outer material layer of the folded down sealing fin 3 and how the continuation of this material layer, that is to say the container side indicated by the reference numeral 4, together with the strengthening element 2 extends around the whole enclosed container volume and takes up the stresses caused by the internal pressure.

It will readily be understood that in this design the internal pressure not only maintains the strengthening element 2 in stretched condition and thus prevents the sealing fin 3 from being folded up to its original position, but that it will also press the sealing fin and the part of the container wall situated within the fin in the direction towards the strengthening element, so that each rise in pressure in the container leads to an increase in the retaining force of the fin. The inside to inside sealing in the fin 3 is thus completely relieved and the forces arising are transmitted instead to the overlap seal present between the strengthening element 2 and the outside (that is to say the container side 4) of the sealing fin. This, however, can be made sufficiently strong without any difficulties to endure the stresses. The strengthening element 2 and the container side 4 can in fact be regarded as serving jointly as a "band" extending around the packed volume. The band, provided an appropriate length has been chosen for the active part of the strengthening element 2, can relieve more or less completely the container wall situated underneath the strengthening element 2, and thus the sealing fins, from tensile stresses.

The strengthening element 2 can be designed in a number of different ways and it can be made of several different materials. As mentioned earlier, it is essential that the material or materials from which the strengthening element is made has a coefficient of expansion which is the same as or lower than the material combination from which the container itself is made, since otherwise the sealing fin will be subjected to stresses. The strengthening element may, as shown in FIG. 1, have wider ends and a narrower middle portion, or else it may be of uniform thickness along its whole length.

Figure 4:
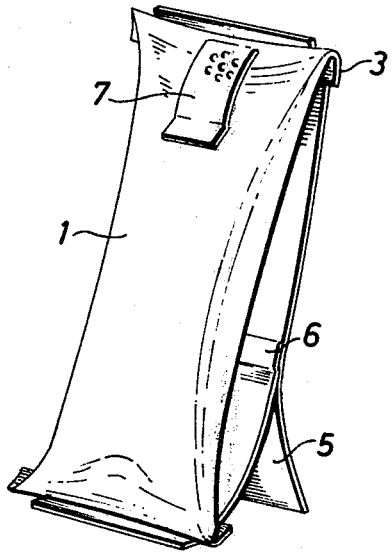
FIG. 4 is a perspective view of a somewhat modified embodiment of the packing container in accordance with the invention.

An alternate embodiment of the strengthening element is illustrated in FIG. 4, where the strengthening element is relatively wide and made of a rigid laminate which comprises layers of fibrous material. In this way the strengthening element can serve as a gripping element or handle in the manipulation of the packing container. It is further evident from FIG. 4 how the strengthening element may form a supporting surface at the bottom end of the packing container. In accordance with the alternate embodiment, the strengthening element then comprises a fold-out supporting element 5 which together with the bottom end of the strengthening element itself forms a supporting surface for the packing container. The strengthening element is manufactured from two separate parts which are joined by means of a transverse seal 6, which will be described in more detail in the following.

The packing container in accordance with the invention is also provided with an opening arrangement located at the upper end in the form of a pouring opening 8 closed by means of a tear-off cover strip 7. The pouring opening may be in the form of one or more punched holes provided in the material. The cover strip, which like the strengthening element is made of a material that can be joined to the container material, has a free, grippable end which appropriately may be joined permanently at its opposite end to the packing container so that it cannot be separated from the packing container after the opening. The cover strip 7 may extend, for example, underneath the upper end of the strengthening element 2 and be permanently joined there between the strengthening element and the sealing fin 3.

The packing containers in accordance with the invention are manufactured such that a web of material for the manufacture of the container 1 is fed to a packing machine. The material is supplied in the form of a roll and is converted during its movement through the machine successively to tubular shape with overlapping longitudinal edges, which are heat-sealed to each other so as to form a liquid-tight, longitudinal overlap joint. The liquid-tight tube if then filled with contents and is converted to individual, cushion-shaped containers by repeated flattening in zones extending transversely over the tube. By heating to the softening temperature of the material concerned and pressing together of the tube material in the said zones, liquid-tight seals across the tube are achieved, and, after cutting through the said seals, the cushion-shaped, fully filled containers are ready.

Subsequently the projecting sealing fins are folded down against the outside of the container and retained in this position with the help of the strengthening element which is applied to the outside of the container and joined to the two fins. A particularly purposeful manner of application of the strengthening element is achieved if the strengthening element consists of two parts, each of which is sealed to the respective sealing fin. The sealing of the strengthening element to the respective sealing fin may take place while the sealing fin is in its original position, that is to say before it has been folded down, which appreciably improves accessibility and facilitates the work. After the respective parts of the strengthening element have been attached to the sealing fins the latter are folded down together with the two parts of the strengthening element against the outside of the container in such a manner that the fins will be located underneath the strengthening element, that is to say between the strengthening element and the container wall. The two parts of the strengthening element will then be stretched towards each other so that the strengthening element is given a certain initial tension, whereupon the two parts are joined together by means of a transverse seal 6.

By adapting the initial tension of the strengthening element to the internal pressure in the packing container, the tensile stresses upon the underlying container side can be reduced to a desired extent, as a result of which a relief of the sealing fins is also achieved. The initial tension of the strengthening element is appropriately such that in its effective position it lies against the outside of the container and takes up the greater part of the axial tensile stresses which are caused by the internal pressure in the container. However, the initial tension must not be too strong since otherwise the underlying container side might be creased, and the container given a deformed appearance. It is also important in this connection that only the ends of the strengthening element are joined to the container (that is to say the fins) since the strengthening element, if it is fixed to the container wall along the remaining parts of its length, will be unevenly stressed and will cause formation of wrinkles on the container side.

The packing container described has a height of approx. 200 mm and a diameter of approx. 50 mm, that is to say a height/diameter ratio of 4:1. This ratio can be varied, of course, depending on the desired size and shape of the package. It is also possible to alter the dimensions of the packing container as well as the orientation of the strengthening element. It is possible, for example, for both fins of the packing container to extend vertically and be joined by means of a strengthening element whose width by and large corresponds to the height of the packing container.

The principles, preferred embodiments and modes of operation of the present invention have been described in the foregoing specification. The invention which is intended to be protected herein should not be construed as limited to the particular forms disclosed, since these are to be regarded as illustrative rather than restrictive. Variations and changes may be made by those skilled in the art without departing from the spirit of the present invention.

What is claimed is:

1. A packing container for pressurized contents, comprising:

a tubular container body;

a transverse sealing fin disposed at each end of said container body to seal said container body, said sealing fin having inside surfaces of said body sealed together; and a strengthening band, lying outside said container body disposed only on one side of said container body and secured only to said sealing fins, said sealing fins being folded down against said container body on said one side, and said band being sealed to said fins whereby said band holds said sealing fins folded down against said container body to take up axial tensile stresses on said sealing fins caused by internal pressure in said container body and to prevent the pressurized contents from leaking out through said sealing fins.

2. A packing container for pressurized contents, comprising:

a container body including two transverse sealing fins situated at opposite ends of said container, each of said sealing fins being folded down against the outside of said container body; and strengthening means for joining said two sealing fins to each other to take up tensile stresses on said sealing fins caused by internal pressure in said container body, said strengthening means including end regions, said end regions overlapping the respective sealing fins and being joined thereto, whereby each sealing fin is positioned between said end region and the outside of the container.

3. The packing container of claim 2 wherein said strengthening means includes a band-like strengthening element disposed outside said container body along one side thereof, said element being long enough to bear axial stresses which are caused in said transverse sealing fins of said container body and wherein said element is joined only to said fins.

4. The packing container of claim 3 wherein a length of said strengthening element is equal to a distance between the sealing fins measured along the outside of the container body.

5. The packing container of claim 3 wherein both the container body and the strengthening element comprise layers of oriented thermoplastic material.

6. The packing container of claim 3 or 1 wherein the strengthening band further includes a supporting element hingedly connected to said strengthening band so that a bottom end of said strengthening band and a bottom end of said support element form a base upon which the packing container may be rested and wherein the supporting element serves as a handle.

7. The packing container of claim 3 or 1 wherein said strengthening band is of a material having a coefficient of linear expansion no higher than the coefficient of linear expansion of the material from which the container body is made.

8. The packing container of claim 3 or 1 wherein the strengthening band includes a stiffening portion which serves also as a gripping element.

9. The packing container of claim 2 wherein said container body is a flexible tube which tube on both of its ends is flattened and wherein inside surfaces of said flattened end portions of said tube are sealed together to form mutually parallel sealing fins and to create a cushion-shaped, liquid-tight container.

10. The packing container of claim 9 wherein said end regions of said strengthening means are joined to said sealing fins by overlap joints.

11. The packing container of claim 2 further comprising:

a pouring opening in said container body said pouring opening including a plurality of holes of which at least one is situated in an upper surface of said container body close to one of said sealing fins; and a tear off cover strip which closes said pouring opening.

12. The packing container of claim 11 wherein said cover strip is at one end permanently attached to said container body.

13. In a cushion-shaped packing container for pressurized contents, the packing container having a body and transverse sealing fins at each end of the body, the improvement comprising:

a strengthening element which holds the sealing fins folded down against the packing container to prevent the pressurized contents from leaking out through said sealing fins, said strengthening element being sealed only to said sealing fins and not to said body wherein said strengthening element takes up axial tensile stresses on said sealing fins caused by internal pressure in the packing container and wherein the strengthening element includes:

a first portion sealed to a top sealing fin;

a second portion sealed to a bottom sealing fin; and a sealing zone between said portions at which sealing zone said first and second portions are sealed to each other.

14. The packing container of claim 13 wherein the strengthening element further includes a fold out supporting portion which together with a bottom end of said second portion forms a base upon which said packing container may be rested.

* * * * *